US005752701A

United States Patent [19]

Kao

[11] Patent Number: 5,752,701

[45] Date of Patent: May 19, 1998

[54] GAME DEVICE

[76] Inventor: Fang-Shoung Kao, No. 44, Lane 166, Ta-Hu St., Nei-Hu Dist., Taipei, Taiwan

[21] Appl. No.: 843,018

[22] Filed: Apr. 11, 1997

[51] Int. Cl.[6] ..... A63F 3/00

[52] U.S. Cl. ..... 273/269; 273/153 R; 273/282.1; 273/272; 434/403

[58] Field of Search ..... 273/269, 272, 273/273, 276, 282.1, 156, 157 R, 153; 434/171, 172, 176, 200, 208, 211, 403

[56] References Cited

U.S. PATENT DOCUMENTS

| | | | |
|---|---|---|---|
| 2,659,163 | 11/1953 | Albee | 273/273 |
| 3,966,209 | 6/1976 | Gambardella | 273/153 R |
| 4,150,828 | 4/1979 | Marchese | 273/282.1 |
| 5,120,226 | 6/1992 | Tsai | 434/208 |
| 5,626,477 | 5/1997 | Adkison | 273/273 |

*Primary Examiner*—William M. Pierce
*Attorney, Agent, or Firm*—Fish & Richardson P.C.

[57] ABSTRACT

A game device includes a plurality of game blocks, at least two playing cards, and at least two hollow game boxes. The game blocks are grouped into at least three sets by shapes and sizes so that each of the game blocks belonging to a particular set has a cross section different from those of the game blocks belonging to the other sets. Each set is further grouped into at least two subsets by a predetermined printed matter thereon. Each of the playing cards has at least three rows and at least two columns of patterns. Each pattern is a combination of the cross section of the set and at least one print of the subset. Each of the game boxes includes an upright front wall formed with an elongated slot to permit insertion of a selected one of the playing cards thereinto, and an upper game board which defines at least three rows and at least two columns of openings respectively corresponding to in cross section and superimposed upon the patterns of the playing card.

4 Claims, 6 Drawing Sheets

GAME DEVICE

BACKGROUND OF THE INVENTION

1. Field of the Invention

The invention relates to a game device, more particularly to a game device which requires removal of game blocks variably and selectively from a game box with the aim of arranging the removed space into a predetermined design.

2. Description of the Related Art

Bingo is a game played and appreciated by young and old alike. Each of the participants of a bingo game is given a bingo card provided with a unique set of numbers. When a number is drawn randomly from a bag and is called out by the caller, the participants compete by covering the corresponding numbers with tokens in the given card. The first participant to achieve a predetermined arrangement of tokens on the bingo card becomes the winner of the game.

SUMMARY OF THE INVENTION

The object of this invention is to provide an alternate game device which permits a number of participants to remove game blocks variably and selectively from a game box in a race to arrange the removed space into a predetermined design.

Accordingly, the game device of this invention includes a plurality of game blocks, at least two playing cards, and at least two hollow game boxes. The game blocks are grouped into at least three sets of predetermined shapes and sizes so that each of the game blocks belonging to a particular set has a cross section different from those belonging to the other sets. Each set of the game blocks is further grouped into at least two subsets by means of predetermined printed matter thereon. Each of the playing cards has at least three rows and at least two columns of patterns. Each of the patterns is a combination of the cross section of one of the sets of the game blocks, and the printed matter on one of the game blocks. Each of the game boxes includes an upright front wall formed with an elongated slot to permit insertion of a selected one of the playing cards thereinto, and an upper game board which defines at least three rows and at least two columns of openings which are superimposed and which correspond in cross section to the patterns on the playing cards.

BRIEF DESCRIPTION OF THE DRAWINGS

Other features and advantages of this invention will become apparent in the following detailed description of the preferred embodiments of this invention, with reference to the accompanying drawings, in which.

DETAILED DESCRIPTION OF THE PREFERRED EMBODIMENTS

Figure 1:
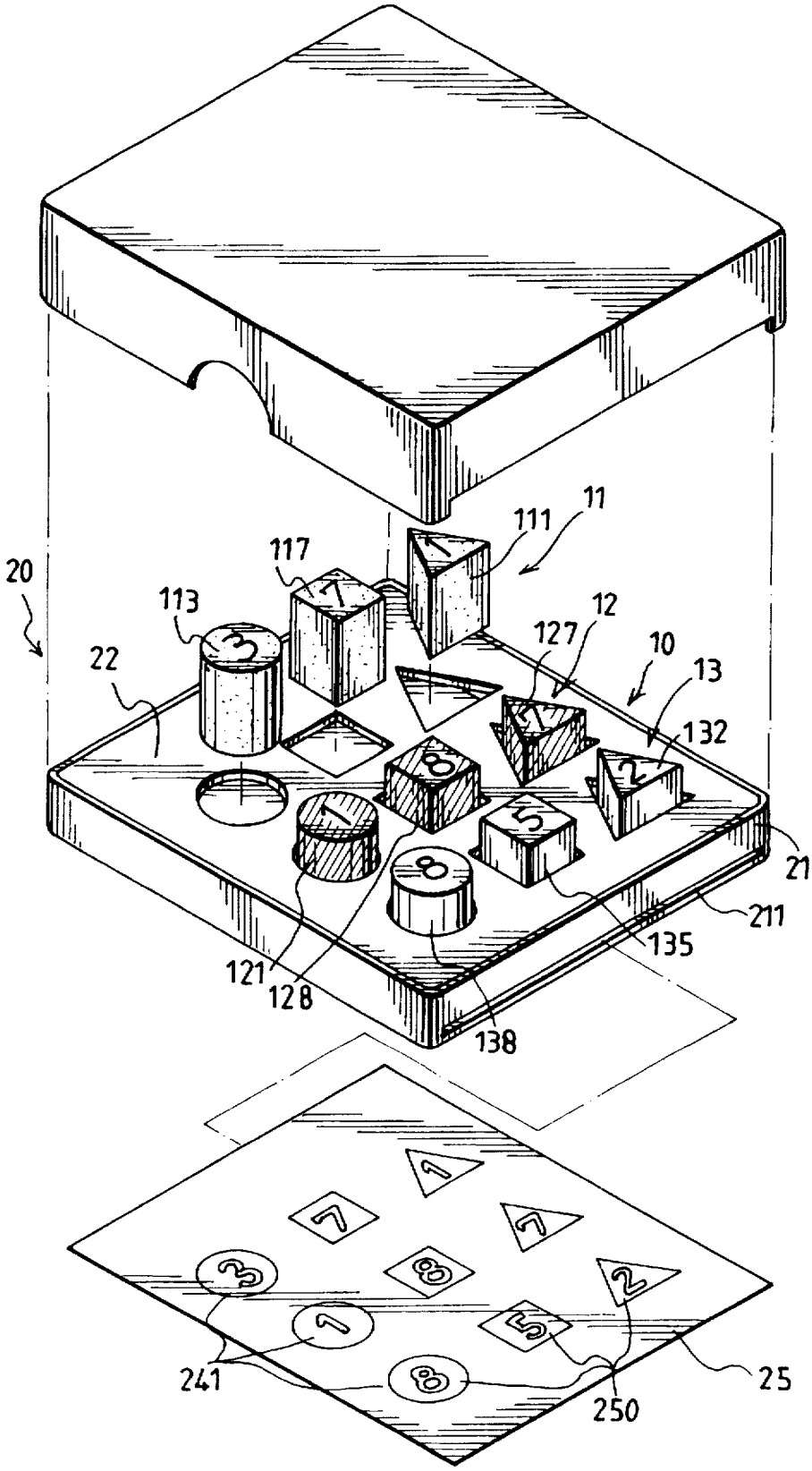
FIG. 1 is an exploded view of a game device of this invention.

Before the present invention is described in greater detail, it should be noted that same reference numerals have been used to denote like elements throughout the disclosure. The dotted game blocks are colored red. The game blocks with shading lines are colored yellow. The game blocks which are neither dotted nor shaded are colored green.

Figure 2:
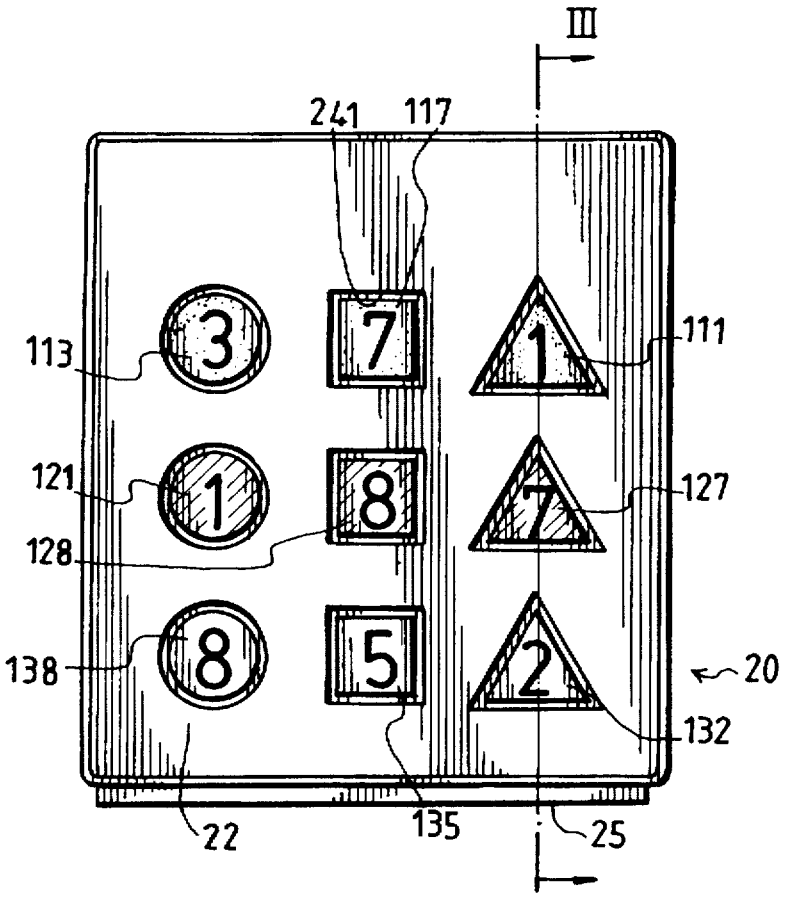
FIG. 2 is a top view of a game box employed in the game device of this invention, wherein a playing card is inserted into the game box.

Referring to FIGS. 1 and 2, the preferred embodiment of a game device according to this invention includes a plurality of game blocks 10, at least two playing cards 25, and at least two hollow game boxes 20.

The game blocks 10 can be grouped into three sets 11, 12, 13 of predetermined shapes and sizes so that each of the game blocks 10 belonging to the set 11 has a cross section different from those belonging to the other sets 12, 13. Each set 11, 12, 13 of the game blocks 10 can be further grouped into three subsets by means of predetermined printed matter thereon. The game blocks 10 of the sets 11, 12, 13 have two opposed upper and lower faces so as to permit formation of the predetermined printed matter thereon. In the preferred embodiment, there are nine identical pieces of game blocks 10 in each of the sets, namely (111, 112, . . . . 119), (121, 122, . . . . 129), (131, 132, . . . . 139). The predetermined printed matter includes a first print for grouping the game blocks 10 of each of the sets into three subsets, and a second print for distinguishing the game blocks 10 belonging to one of the subsets from each other. The first print includes different colors, such as red, yellow and green which are used to group the game blocks 10 of each of the sets 11, 12, 13 into three subsets. Thus, there are three red game blocks, three yellow game blocks and three green game blocks in each of the sets 11, 12, 13 of the preferred embodiment. The second print includes a plurality of alphanumerical prints, such as the numbers 1 to 9 or the characters A to Z. In this preferred embodiment, the upper and lower faces of each of the game blocks 10 are respectively printed with different second prints.

Each of the playing cards 25 has three horizontal rows 241 and three vertical columns 250 of patterns. Note that each of the patterns is a combination of the cross section of one of the sets 11, 12, 13 of the game blocks 10 and one of the printed matter on the game blocks 10 of one of the subsets.

Each of the game boxes 20 includes an upright front wall 21 formed with an elongated slot 211 to permit insertion of a selected one of the playing cards 25 thereinto, and an upper game board 22 which is formed with three rows and three columns of openings corresponding to the cross sections of the game blocks 10 respectively. When one of the playing cards 25 is inserted into the box 20, the rows 241 and columns 250 of openings in the upper game board 22 are superimposed on the patterns on the playing card 25.

Figure 3:
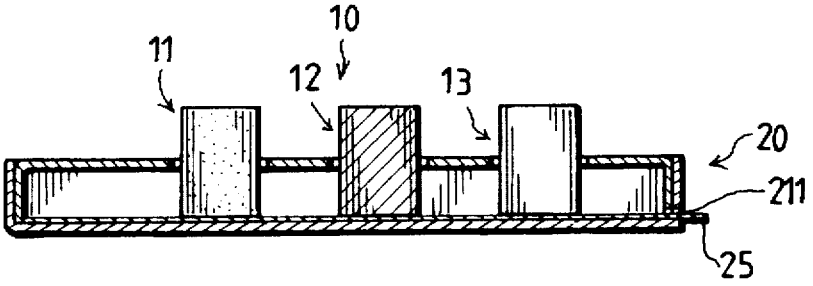
FIG. 3 is a cross sectional view of FIG. 2 taken along line III—III.
Figure 4:
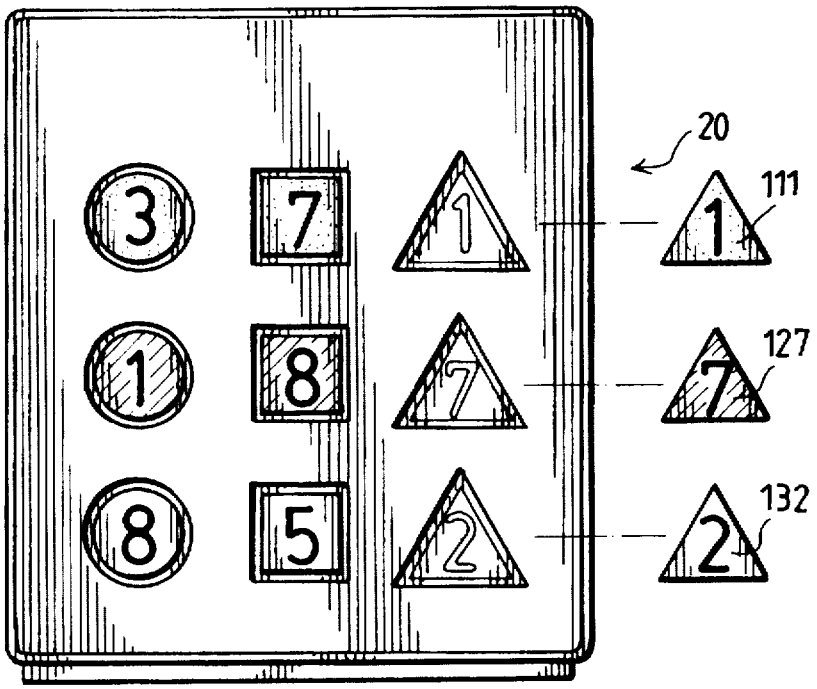
FIG. 4 illustrates how the removal of a set of game blocks from the game box forms a column of space in the game box according to this invention.

Referring to FIGS. 3 and 4, before the start of a game, each of the participants is issued with a playing card 25 that is inserted into the slot 211 of the respective box 20. Thereafter, the openings in the game board 22 are filled with the game blocks 10 selectively in such a manner that the three columns of the openings are filled respectively by the three sets of game blocks 10, that the selected game blocks 10 in each set belong to the different subsets, and that the second print on the game blocks 10 correspond to the patterns on the inserted playing card 25. It is then declared in advance that three game blocks 10 belonging to the same set but belonging to the different subsets must be removed from the respective box 20 to form a column of space. The caller will randomly draw out a number from a bag and calls out the drawn number. Each participant then searches for a game block 10 on the game box 20 that is printed with the drawn number and removes the same from the game board 22. In the example of FIG. 4, the drawn numbers are 1, 7 and 2 respectively. The participant has the option of removing the game blocks 111, 127, 132, thereby forming a column of space. The first participant to form the required column of space is declared the winner.

Figure 5:
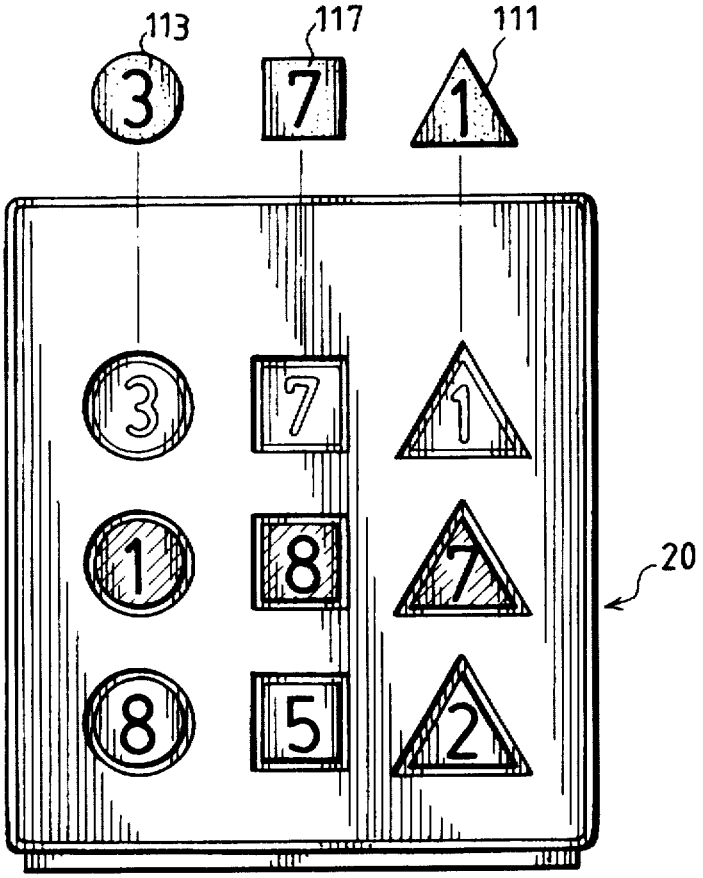
FIG. 5 illustrates how the removal of three different game blocks having different shapes but with the same color from the game box forms a row of space in the game box according to this invention.

Referring to FIG. 5, it is declared in advance that three game blocks 10 belonging to different sets but having the same colors must be removed from the respective box 20 in order to form a row of space. In the example of FIG. 5, if the drawn numbers are 1, 3 and 7 respectively, the participant has the option of removing the game blocks 111, 117, 113 from the game board 22 of the box 20 in order to win the game.

Figure 6:
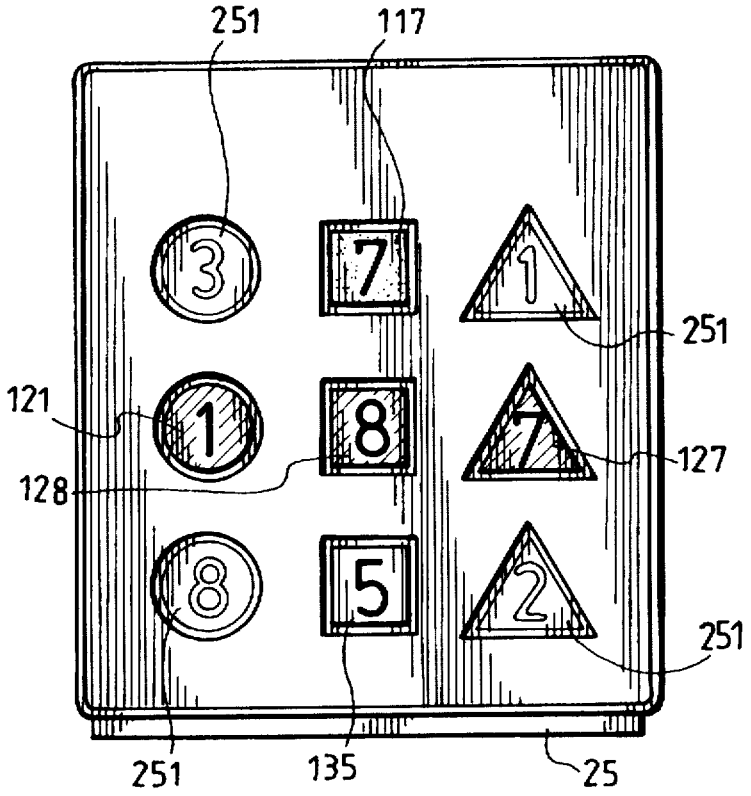
FIG. 6 illustrates how a cross-shaped pattern of game blocks is formed in the game box according to this invention.

Another method of playing will be described with reference to FIG. 6. The caller declares in advance that four game blocks 10, must be removed from the respective box 20 in order to form a cross-shaped pattern. In the example of FIG. 6, if the drawn numbers are 1, 2, 3 and 8 respectively, the participant has the option of removing the game blocks 10 from the openings indicated by 251 such that the remaining game blocks 121, 128, 127, 117, 135 form the required cross-shaped pattern.

Figure 7:
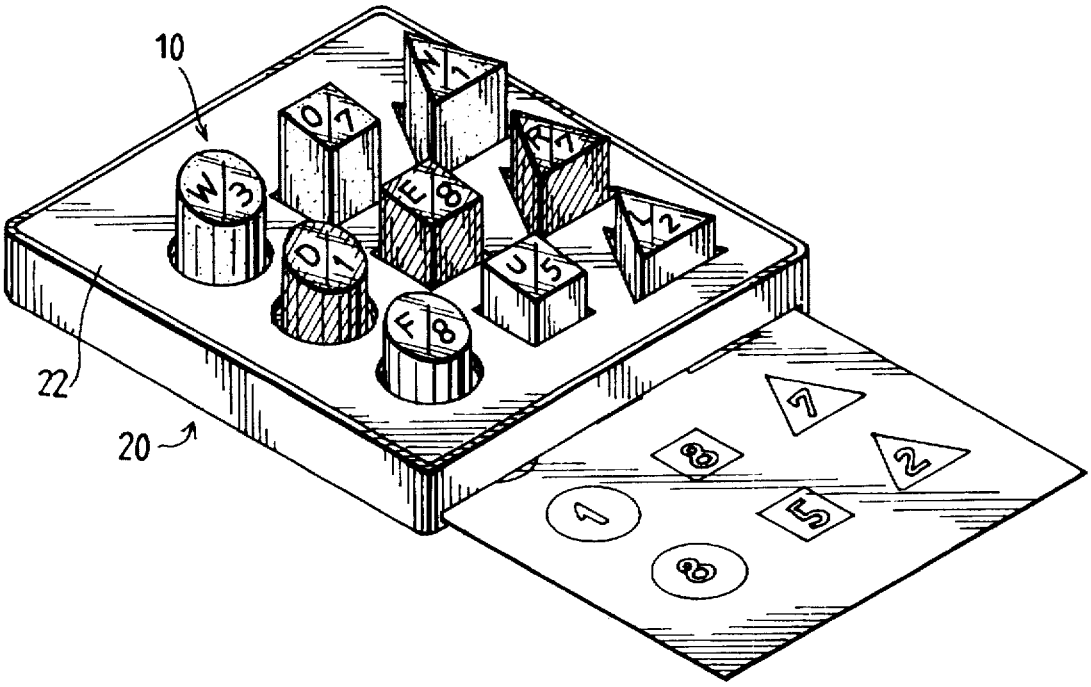
FIG. 7 illustrates another preferred embodiment of a game device of this invention.

As illustrated in FIG. 7, note that each of the game blocks 10 in each of the sets is further provided with a particular character thereon in addition to the number. Thus, the participants can compete in a race to form a word. In the example of FIG. 7, whoever can form the word "wonderful" outside the game box 20 is declared the winner. When the caller draws a number from the bag and calls out the drawn number, the participant searches for the game block 10 that is provided with the drawn number and removes the same from the game box 20. Whoever can remove all of the game blocks 10 first, is declared the winner of the game, because the removed game blocks can be arranged in such a manner to for the word "wonderful".

The above-mentioned playing methods are some examples which illustrate the many different ways of playing the game device of this invention. More than three rows and three columns of openings can be formed through the upper game board 22 to result in a greater number of available game playing ways.

With this invention thus explained, it is apparent that numerous modifications and variations can be made without departing from the scope and spirit of this invention. It is therefore intended that this invention be limited only as indicated in the appended claims.

I claim:

1. A game device comprising:

a plurality of game blocks grouped into at least three sets of predetermined shapes and sizes so that each of said game blocks belonging to a particular one of said sets has a cross section different from those belonging to the other sets, each set of said game blocks being further grouped into at least two subsets by means of predetermined printed matter thereon;

at least two playing cards, each having at least three rows and at least two columns of patterns, each of said patterns being a combination of said cross section of one of said sets of said game blocks and said printed matter on one of said game blocks; and at least two hollow game boxes, each including an upright front wall formed with an elongated slot to permit insertion of a selected one of said playing cards thereinto, and an upper game board defining at least three rows and at least two columns of openings superimposed on and corresponding in cross section to said patterns on the selected one of said playing cards.

2. The game device as defined in claim 1, wherein said predetermined printed matter includes a first print for grouping said game blocks into said subsets, and a second print for distinguishing said game blocks in one of said subsets from each other.

3. The game device as defined in claim 2, wherein said first print on said game blocks in each of said subsets includes a color print unique to each of said subsets, said second print being an alphanumeric print.

4. The game device as defined in claim 3, wherein each of said game blocks has two opposed upper and lower faces provided respectively with said second print thereon.

* * * * *